United States Patent [19]

Creaden

[11] Patent Number: 5,058,744

[45] Date of Patent: Oct. 22, 1991

[54] MINIMUM LENGTH FLUOROESCENT TUBE DUNNAGE ELEMENT

[75] Inventor: David E. Creaden, Lawrence, Kans.

[73] Assignee: The Lawrence Paper Company, Lawrence, Kans.

[21] Appl. No.: 568,754

[22] Filed: Aug. 17, 1990

[51] Int. Cl.[5] ..... B65D 85/42

[52] U.S. Cl. ..... 206/419; 206/519; 206/587

[58] Field of Search ..... 206/418–422, 206/443, 518, 519, 585, 587, 591–594; 217/26.5, 27, 35; 220/23.6, 23.8

[56] References Cited

U.S. PATENT DOCUMENTS

| | | | |
|---|---|---|---|
| 3,223,234 | 12/1965 | Weiss | 206/587 |
| 3,708,084 | 1/1973 | Bixler et al. | 217/26.5 |
| 4,427,730 | 1/1984 | Robbins et al. | 206/419 |
| 4,705,170 | 11/1987 | Creaden | 206/443 |
| 4,792,045 | 12/1988 | Creaden | 206/419 |
| 4,936,453 | 6/1990 | Knitter | 206/443 |
| 4,942,965 | 7/1990 | Comer | 206/443 |

*Primary Examiner*—Jimmy G. Foster

*Attorney, Agent, or Firm*—Hovey, Williams, Timmons & Collins

[57] ABSTRACT

An improved synthetic resin dunnage element (10) for use in packaging and shipping of fluorescent tubes (76,78) is provided which is specifically designed to be of minimum fore and aft length while still providing maximum protection against tube breakage. The support (10) is of integral, thermoformed construction and advantageously includes alternating upwarding and downwardly opening and diverging wall sections (68,70,70*a*) with the fowardmost downwardly opening section (70*a*) being of lesser width, greater radius and vertically lower in position than the associated rearward sections (70). In this fashion the forwardmost sections (79*a*) engage the fluorescent tube end caps (82) whereas the sections 70 engage the glass tube body. Provision of such specialized, different downwardly opening wall sections (70,70*a*) allows the support (10) to be manufactured using substantially less starting sheet material as compared with prior supports.

7 Claims, 2 Drawing Sheets

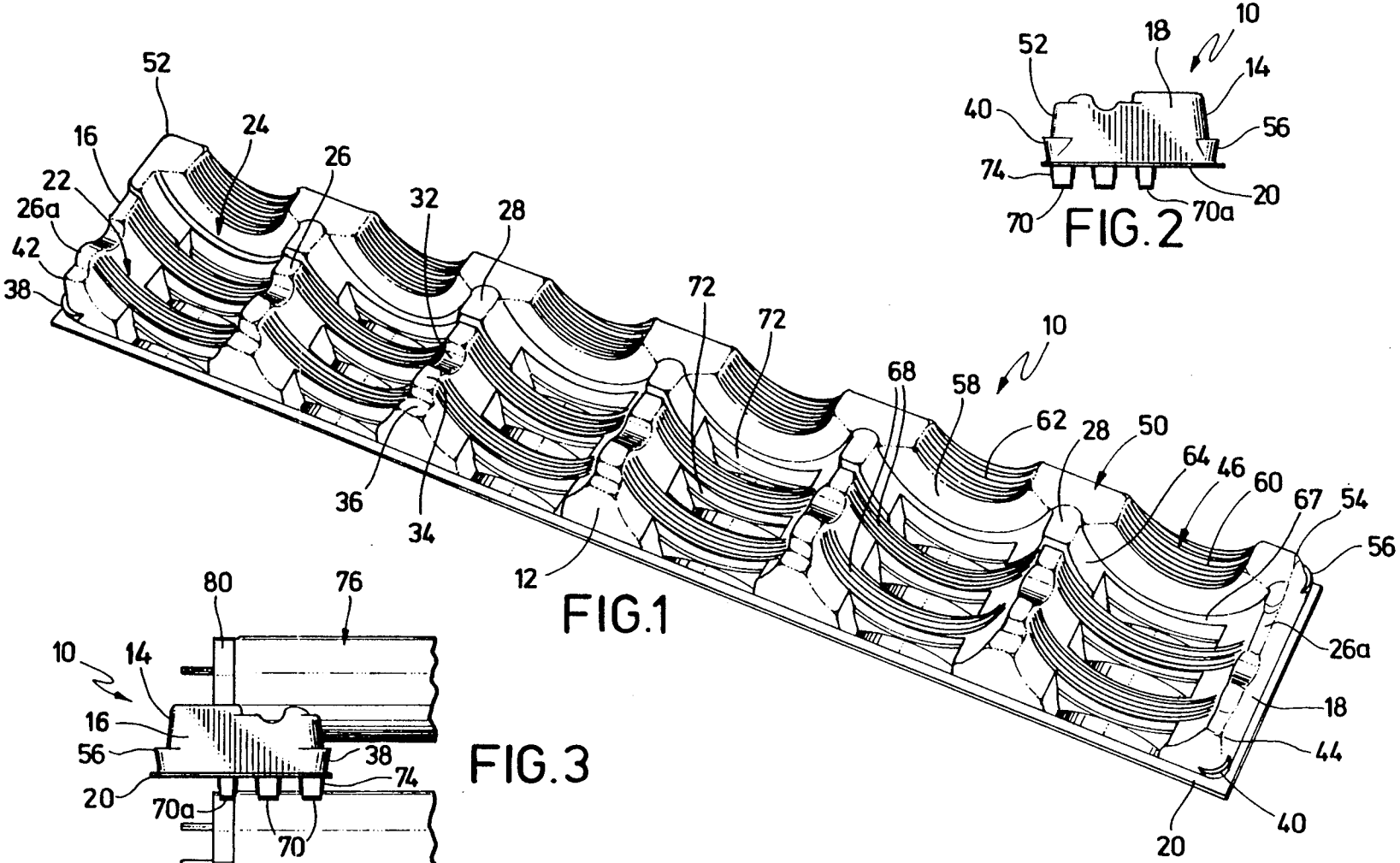
FIG. 2
FIG. 1
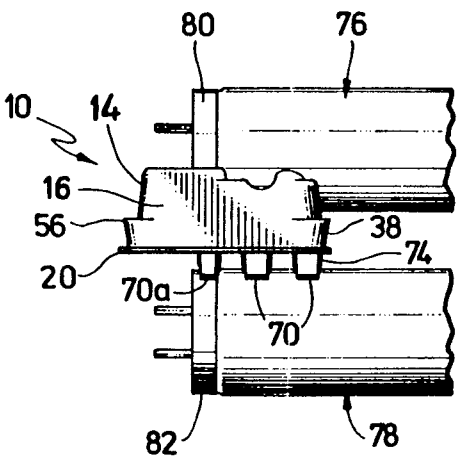
FIG. 3

MINIMUM LENGTH FLUOROESCENT TUBE DUNNAGE ELEMENT

BACKGROUND OF THE INVENTION

1. Field of the Invention

The present invention is broadly concerned with improved synthetic resin fluorescent tube supports adapted to be used in the packaging and shipping of elongated fluorescent tubes in order to prevent breakage thereof. More particularly, it is concerned with a tube support of the general type described in U.S. Pat. No. 4,705,170, which has been improved by specific structural features enabling the support to be fabricated using significantly less synthetic resin material, while at the same time giving equivalent or even enhanced tube protection.

2. Description of the Prior Art

U.S. Pat. No. 4,705,170 and 4,792,045 describe fluorescent tube dunnage supports formed of integral, synthetic resin sheet material which are designed to be used in lieu of traditional supports manufactured from pulp or the like. A prime advantage of the supports described in the mentioned patents stem from the fact that they are machine dispensable, i.e. they overcome the problems heretofore associated with attempts at machine dispensing pulp tube supports, and thereby lower manufacturing costs.

The tube supports described in these patents represent a substantial breakthrough in the art, and are commerically successful. However, increases in the cost of preferred synthetic resin materials (e.g. polyvinylchloride) have led to attempts to fabricate the supports using smaller quantities of synthetic resin. The straightforward approach of simply shortening the fore and aft length thereof has proved unsuccessful, inasmuch as modified supports simply do not provide the degree of breakage protection demanded by fluorescent tube manufacturers.

One response to the aforementioned problem is described in pending application per U.S. letters patent Ser. No. 07/396,562 filed Aug. 21, 1989. This application describes fluorescent tube supports specifically designed with sawtooth-like top walls between adjacent tube-receiving concavitie, along with specifially configured, upwardly and downwardly diverging, alternating wall sections along the length of the concavities thereof. These structural changes permit fabrication of a significantly shorter dunnage support without sacrifice of the necessary tube-protective functions thereof.

SUMMARY OF THE INVENTION

The present invention provides another approach to the design and fabrication of a minimum length fluorescent tube dunnage support which gives the necessary degree of tube protection to meet the dictates of customer demand. To this end, the tube supports of the present invention are preformed, integral bodies formed of synthetic resin sheet material (e.g. polyvinylchloride polyesters or polyethylene terepthalate). The dunnage body is configured to present concave-convex walls defining a number of elognated, open-top, parallel, juxtaposed, concave, tube-receiving regions each presenting a first fluorescent tube end cap-engaging area adjacent the forward end thereof, and a second tube-engaging area rearward of the first area. Advantageously, the region-defining walls of the body include a plurality of axially spaced, apart, downwardly opening and diverging arcuate wall sections, so that a given support is designed to simultaneously engage a pair of superposed rows of fluorescent tubes. One specific improvement contemplated by the present invention is the provision of first wall sections adjacent to and effectively defining the first areas of the tube-receiving concavities, with the first wall sections having widths which are less than the widths of the wall sections adjacent the second areas (all widths being measured in a direction parallel with the longitudinal axes of the tube-receiving regions). Stated otherwise, the supports of the invention preferably include a relatively narrow downwardly opening and diverging wall which is specifically configured to engage the metallic end cap of a fluorescent tube whereas the remaining associated wall sections are of greater width and are designed to engage the glass tube itself.

The preferred supports also include first wall sections adjacent to the end cap-engaging portions of the supports which present radii different than the radii of the wall sections designed to engage the glass tubes themselves. In particular, the radii presented by these first wall sections are greater than that of the glass tube-engaging wall sections.

Finally, by virtue of the construction of the supports hereof, the first wall sections designed to engage the fluorescent tube end cap are located vertically below the axially spaced wall sections configured for engaging the fluorescent tube bodies.

U.S. Pat. Nos. 4,705,170 and 4,792,045 are incorporated by reference herein, along with pending applications for U.S. letters patents Ser. No. 07/396,562 filed Aug. 21, 1989 and concurrently filed application in the name of David E. Creaden, Ser. No. 07/568,014, filed Aug. 16, 1990 and entitled "Molded Fluorescent Tube Dunnage Element."

BRIEF DESCRIPTION OF THE DRAWINGS

FIG. 1 is a perspective view of the preferred tube support in accordance with the invention;

FIG. 2 is a side elevational view thereof;

FIG. 3 is a side elevational view thereof opposite that illustrated in FIG. 2, and depicting the orientation of the tube support in engaging a pair of superposed fluorescent tubes;

DESCRIPTION OF THE PREFERRED EMBODIMENT

Figure 4:
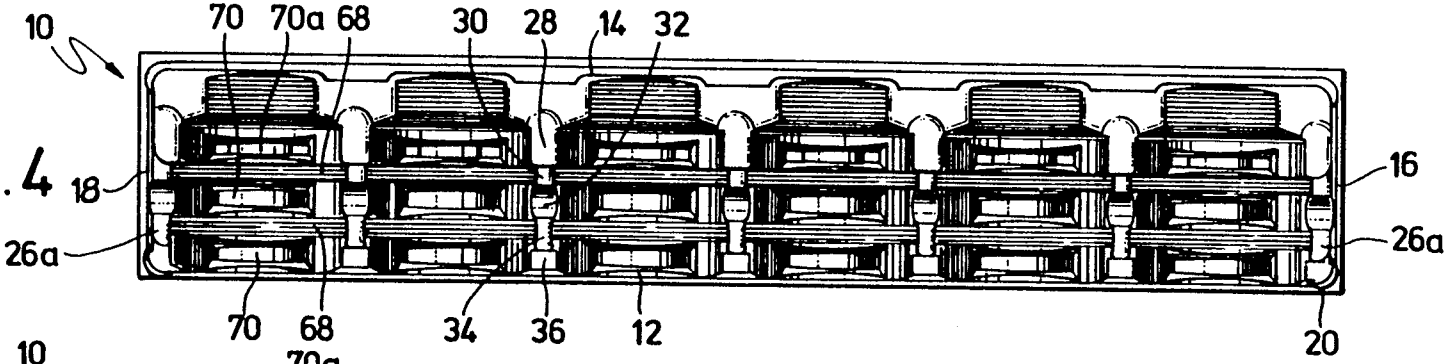
FIG. 4 is a plan view of the tube support depicted in FIGS. 1–3.

Turning now to the drawings, a minimum length tube support 10 is illustrated in FIG. 1 and is in the form of an integral, synthetic resin, thermoformed body presenting a rear wall 12, front wall 14 and interconnecting end walls 16, 18. The walls 12–18 include, at the lowermost extent thereof, a common, circumscribing, short, laterally extending peripheral lip 20.

The overall support 10 is further provided with a total of six concavo-convex wall sections 22 which cooperatively present a plurality of individual, elongated, open-top, parallel, juxtaposed concave tube-receiving sockets or regions 24. It will be noted in this respect that the regions 24 terminate at rear wall 12, with the latter presenting an overall scalloped appearance. The wall sections 22 are joined at their respective apices by way of elongated, fore- and aft-extending connector walls 26 each presenting an uppermost ridge area 28 adjacent front wall 14 as well as, in order, a flattened pad section 30, arcuate depression 32, pad section 34, and terminal, flattened depression 36.

The rear wall 12 is an upstanding member which is slightly inclined as best seen in FIGS. 1 and 2, and includes, adjacent each end thereof, outwardly projecting stacking lugs 38, 40. The rear wall 12 merges with the end walls 16, 18, at the rounded corners 42, 44 at the regions of lugs 38, 40.

Front wall 14 is an upright member having a total of six laterally spaced apart, arcuate pin-receiving recesses 46 formed therein, with each of the latter being in alignment and in communication with a corresponding, rearwardly extending tube-receiving region 24. In addition, the face of front wall 14 is provided with a total of six somewhat trapezoidal, upright indentations 48 which are positioned in alternating relationship with respect to the recesses 46. Each indentation 48 is aligned with a somewhat triangularly shaped wall section 50 which is in turn aligned with a corresponding connector wall 26 and specifically ridge section 28 thereof. The front wall 14 is merged into end walls 16, 18 at rounded corners 52, 54. Finally, it will be seen that front wall 14 is provided with a transversely extending ledge 56 extending along the length thereof between the corners 52, 54. The ledge 56 is spaced slightly below the recesses 48 and in effect defines the bottoms of the indentations 48 (see FIG. 6).

The end walls 16, 18 are essentially identical and each is a substantially planar, upright member terminating in an upper connector wall 26*a*, the latter being essentially identical with the intermediate connector walls 26.

Each of the tube-receiving regions 24 is defined by an upstanding, slightly inclined and tapered inner wall portion 58 which is generally parallel with front wall 14 and terminates at its respective ends by merging with the wall sections 50. A fore and aft extending, arcuate connector wall 60 extends between each wall section 58 and front wall 14, the walls 60 as shown also interconnecting a corresponding spaced wall section 50. Furthermore, the individual connector walls 60 are provided with a series of preformed ribs 62 therein.

Figure 5:
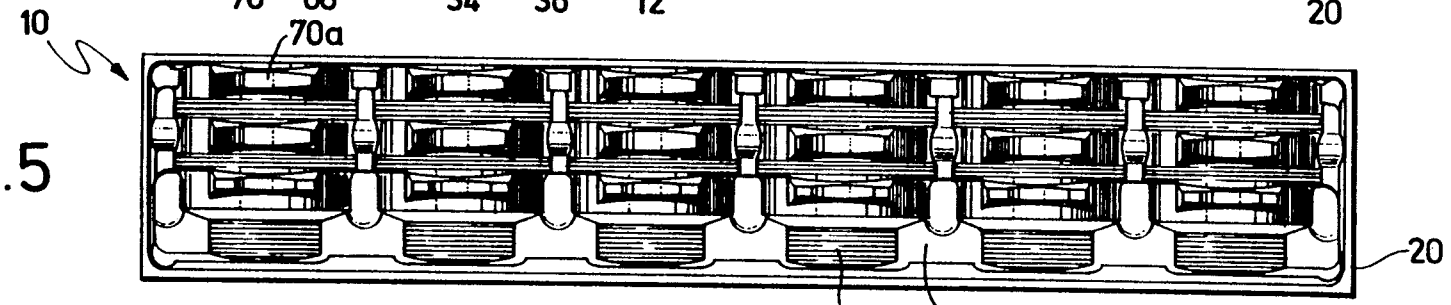
FIG. 5 is a bottom view thereof.

Each region 24 is also defined by a major wall 64 of arcuate, upwardly opening and diverging configuration adpated to receive a fluorescent tube. In each instance the major wall 64 merges into a corresponding pair of connector walls (either a pair of connector walls 26, or a connector wall 26 and end most connector wall 26*a*). The major wall 64 further includes a short, arcuate ledge 67 extending from each wall portion 58, as well as two arcuate, upwardly opening and diverging wall sections 68 each being of ribbed configuration and which are formed to generally conform with the curvature of the glass body of a fluorescent tube. A second pluarlity (here three) of downwardly opening and diverging wall section 70 also forms a part of each major wall 64. As best seen in FIGS. 4 and 5, the walls sections 68, 70 alternate along the length of each major wall portion 64. Further, it will be seen that the alternating wall section 68, 70 are interconnected by upright walls 72.

A review of FIGS. 4–7 will reveal that, a wall section 70*a* is provided closet to front wall 14 which is narrower in width than the remaining associated downwardly diverging sections 70. Furthermore, each wall section 70*a* is formed to present a radius of curvature which is less than that of the associated wall sections 70 (see FIG. 7). Finally, and again referring to FIG. 7, it will be observed that the wall sections 70*a* are located vertically below the corresponding wall sections 70. The importance of these structural details will be made clear hereinafter.

Figure 6:
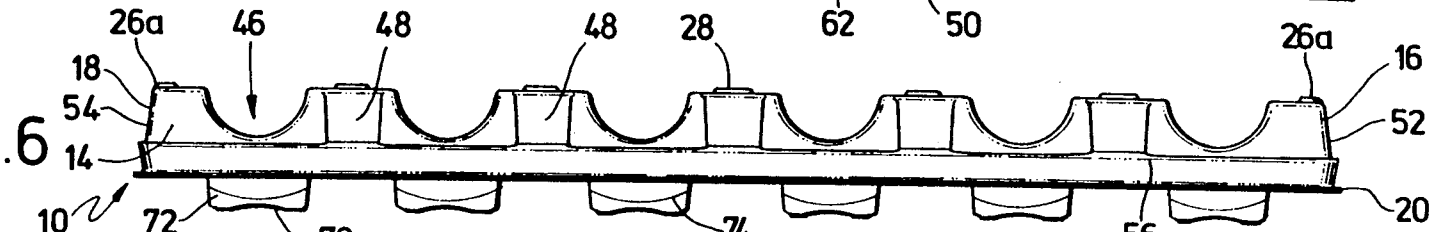
FIG. 6 is a front view thereof.
Figure 7:
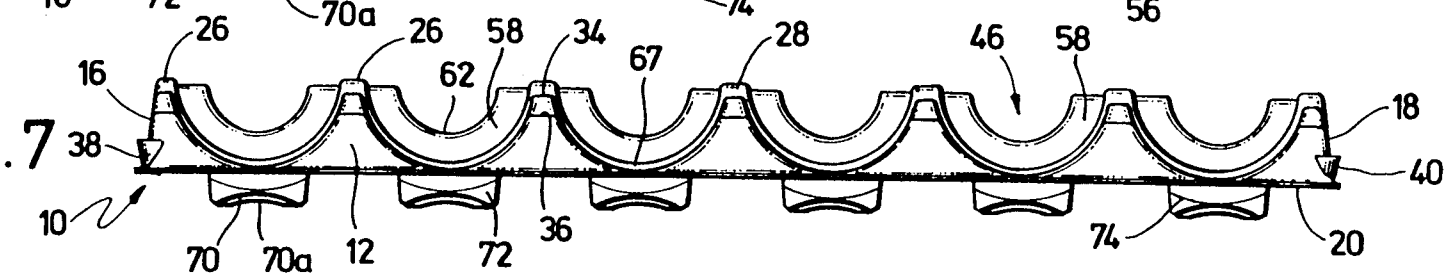
FIG. 7 is a rear view thereof.

In order to assure that the tube supports the invention and do not become completely nested and thus difficult machine dispense, each of the upright walls 72 interconnecting the wall sections 68, 70 is provided with an arcuate ridge 74 which has a curvature opposite to that of the wall sections 70, 70*a* and essentially parallel with that of the upwardly opening wall sections 68. The ridges 74, as best seen in FIGS. 6 and 7, lie completely below peripheral lip 20 and, at their lowest points, come close to the associated walls 70 or 70*a*.

It is a particular feature of the supports of the invention that the wall sections 70*a* are specifically designed to engage the metallic end cap of a fluorescent tube, whereas the rearward wall sections 70, and the upwardly opening wall sections 68, are designed to physically engage the glass tubes themselves. In this connection, attention is specifically directed to FIG. 3, which illustrates a support 10 in simultaneous engagement with a pair of superposed fluorescent tubes 76, 78 each having a metallic end cap 80, 82. As illustrated, the end cap 82 of the tube 78 is engaged by bottom wall 70*a*, whereas the glass tube itself is engaged by the walls 70. Correspondingly, the end cap 80 of upper tube 76 is engaged by the ledge 67, whereas the glass body of the tube is supported by the upwardly opening wall sections 68. It has been found that provision of the narrower cap-engaging walls 70, having the greater radius and vertical orientation described previously, serves to firmly engage the end cap while a similar effect is obtained on the glass tubes themselves by means of the specifically configured walls 70. Finally, the elevated ledges 67, and the rearward wall sections 68, serve a similar function on the tubes actually received within the tube-receiving regions 24. The result is that the fluorescent tubes are fully protected against movement and inadvertent breakage, notwithstanding the fact that the supports of the present invention are approximately 50 percent smaller in length as compared with the supports described in the aforementioned patents.

As explained previously, the supports of the invention include the stacking lugs 38, 40, ledge 56, and ridges 74. All of these operate to maintain the supports in only a partially nested relationship when the supports are stacked prior to actual use thereof for the packaging of fluorescent tubes. That is to say, the supports of the invention may be readily stacked and fed using automatic dispensing equipment, without fear that they will become nested to a degree which would inhibit the easy dispensibility thereof.

The elements 10 may be formed of a wide variety of synthetic resin materials such as polyvinylchlorides, polyesters or polyethylene terpthalates. In the most preferred forms, however, the supports are formed from PVC material having a thickness of about 0.009–0.018 inches or preferably about 0.013–0.018 inches, and most preferably about 0.013–0.014. In addition, while a variety of molding techniques can be employed, it is presently preferred to make use of the female mold for forming the supports 10, with a closely fitted uncooled plug assist.

I claim:

1. In a fluorescent tube support of the type adapted for insertion between respective rows of fluorescent tubes to simultaneously engage a pair of such rows, said support being formed of synthetic resin material and presenting an integral body having concave-convex walls defining a number of elongated, open-top, parallel, juxtaposed concave tube-receiving regions each having a first fluorescent tube end cap-engaging area adjacent the forward end thereof and a second tube body-engaging area rearward of said first area, said region-defining walls including a plurality of axially spaced apart, downwardly opening and diverging arcuate wall sections, the improvement which comprises first wall sections adjacent said first areas of said tube-receiving regions having widths which are less than the widths of said wall sections adjacent said second areas, said widths being measured in a direction parallel with the longitudinal axis of said tube-receiving regions.

2. The tube support of claim 1, said region-defining walls further including a second plurality of axially spaced apart, upwardly opening and diverging arcuate tube-engaging wall sections alternating with said first wall sections, there being upright walls interconnecting said first and second wall sections.

3. In a fluorescent tube support of the type adapted for insertion between respective rows of fluorescent tubes to simultaneously engage a pair of such rows, said support being formed of synthetic resin material and presenting an integral body having concavo-convex walls defining a number of elongated, open-top, parallel, juxtaposed concave tube-receiving regions each having a first fluorescent tube end cap-engaging area adjacent the forward end thereof and a second tube body-engaging area rearward of said first area, said region-defining walls including a plurality of axially spaced apart, downwardly opening and diverging arcuate wall sections, the improvement which comprises first wall sections adjacent said first areas of said tube-receiving regions which present radii different than the radii of the wall sections adjacent said second areas.

4. The tube support of claim 3, said region-defining walls further including a second plurality of axially spaced apart, upwardly opening and diverging arcuate tube-engaging wall sections alternating with said first wall sections there being upright walls interconnecting said first and second wall sections.

5. The tube support of claim 3, said radii presented by said first wall sections being greater than that of said wall sections adajacent said second areas.

6. In a fluorescent tube support of the type adapted for insertion between respective rows of fluorescent tubes to simultaneously engage a pair of such rows, said support being formed of synthetic resin material and presenting an integral body having concavo-convex walls defining a number of elongated, open-top, parallel, juxtaposed concave tube-receiving regions each having a first fluorescent tube end cap-engaging area adjacent the forward end thereof and a second tube body-engaging area rearward of said first area, said region-defining walls including a plurality of axially spaced apart, downwardly opening and diverging arcuate wall sections, the improvement which comprises first wall sections adjacent said first areas of said tube-receiving regions which are located vertically below the wall sections adjacent the wall sections adjacent said second area.

7. The tube support of claim 6, said region-defining walls further including a second plurality of axially spaced part, upwardly opening and diverging arcuate tube-engaging wall sections alternating with said first wall sections, there being upright wall interconnecting said first and second wall sections.

* * * * *